United States Patent [19]

Kestner et al.

[11] 4,304,636

[45] Dec. 8, 1981

[54] METHOD FOR IMPROVING THE BULK DENSITY AND THROUGHPUT CHARACTERISTICS OF COKING COAL

[75] Inventors: Mark O. Kestner, Mendham; Stanley E. Gilewicz, West Orange; Mehmet E. Aktuna, Morristown, all of N.J.

[73] Assignee: Apollo Technologies, Inc., Whippany, N.J.

[21] Appl. No.: 122,517

[22] Filed: Feb. 19, 1980

[51] Int. Cl.[3] ..... C10B 55/02; C10B 57/06

[52] U.S. Cl. ..... 201/20; 44/6; 201/23

[58] Field of Search ..... 201/21, 23, 20; 44/6

[56] References Cited

U.S. PATENT DOCUMENTS

| | | | |
|---|---|---|---|
| 2,378,420 | 6/1945 | Lohr et al. | 201/23 |
| 2,732,333 | 1/1956 | Smith | 201/21 X |
| 2,765,266 | 10/1956 | Throop et al. | 201/21 X |
| 3,563,714 | 2/1971 | Brewer | 44/6 |
| 3,836,354 | 9/1974 | Wienert . | |
| 3,961,914 | 6/1976 | Kindig et al. | 44/6 X |
| 4,024,022 | 5/1977 | Fruhbuss | 201/23 |
| 4,100,314 | 7/1978 | Wallouch . | |

*Primary Examiner*—Frank W. Lutter
*Assistant Examiner*—Roger F. Phillips
*Attorney, Agent, or Firm*—James & Franklin

[57] ABSTRACT

The bulk density and throughput characteristics of coking coal are improved by treating the coal with a surfactant and a combination of fuel oil and alcohol or of solid lubricant and water, the surfactant being soluble in, and increasing the spreading coefficient of, fuel oil or water, as the case may be.

14 Claims, No Drawings

METHOD FOR IMPROVING THE BULK DENSITY AND THROUGHPUT CHARACTERISTICS OF COKING COAL

BACKGROUND OF THE INVENTION

The present invention relates to a method for optimizing the bulk density and throughput characteristics of coal which is used to form coke, and, in particular, to a method which results in minimizing, and even eliminating, the use of fuel oil previously used for that purpose, and to compositions of matter to be used for those purposes.

Coke is a very important element in the manufacture of steel, and is used in very large quantities in the steel making process. It is formed by treating coal in specially designed ovens in order to produce in the coke a very high percentage of fixed carbon. Coke is the solid residue which remains when certain types of bituminous coals are heated to a high temperature out of contact with air until practically all of the volatile matter has been driven off. The residue consists principally of carbon, with minor proportions of hydrogen, nitrogen, sulphur and oxygen (which together constitute the so-called fixed carbon), plus the mineral matter present in the original coal, which has undergone alteration during the coking process. The process of heating bituminous coal in this manner is referred to as carbonization or coking. The properties of coke depend upon the type of coal, or coal mixture, from which it is made and the process and temperature used in its manufacture.

Coke is essentially a partially graphitized and cellular form of carbon, with a specific gravity generally about mid-way between the specific gravities of coal and graphite. It has a cellular structure and high porosity, and hence has a lower bulk density than coal. It is a combination of high graphitization and porosity that gives coke its chief value in the smelting of iron, where a fuel is required which will burn rapidly in the lower regions of the blast furnace, furnishing a high temperature for the melting of the iron and slag. The coke must also have a high mechanical strength in order to withstand rough treatment and to support a bed of molten iron in a blast furnace.

In order to produce coke of optimum characteristics, the bulk density of the coal charged to the coke oven is of critical importance. Generally speaking, the higher the bulk density of coal, the better the coke that is produced therefrom. If the bulk density is too low, the quality of the coke will be poor due to over-firing and it will not possess sufficient strength for subsequent operations of the steel-making process. On the other hand, if the bulk density of the coal charged to the coke oven is too high, an excessive expansion of the charge in the coking oven may damage that oven.

There are, in general, three factors pointing toward use of coal of higher bulk density. In the first place, increase in coal bulk density increases the thermal conductivity of the oven charge, and this results in greater coking rates and a more uniform distribution of heat. In the second place, the specific gravity of coke varies directly with coal bulk density. An increase of 1 lb/ft$^3$ in coal bulk density leads to approximately a 1% increase in the specific gravity of coke. Since the specific gravity is a measure of the degree of carbonization, a higher specific gravity means that the coke contains a higher percentage of fixed carbon and that the coking process has been accomplished more completely. In the third place, coke stability and hardness indices vary directly with coal bulk density. An increase in bulk density of 1 lb/ft$^3$ increases each of those indices by about 0.7. Since coke is used to support a bed of molten metal in a blast furnace, it is desirable to use coke possessing the greatest coal bulk densities lead to coke which is more resistant to shattering upon impact, making it less likely for size degradation to occur during transport and handling.

On the other hand, when coal is coked, it is heated to a temperature at which it fluidizes. As the temperature is raised further, the fluid bed expands as volatile matter is driven off. Once essentially all of the volatile matter has been driven off, the fluid mass solidifies and contracts slightly to form the coke. In some cases, certain coals with excessively high bulk densities may give rise to excessive expansion pressures during coking, and this may damage the oven or its refractory lining. So-called "stickers" may also be formed on the oven walls if the coal bulk density is too high. Consequently, there is an upper limit to bulk density which is determined by coal type and oven construction.

Raw coking coal blends rarely possess the requisite bulk density primarily due to the presence on the coal of surface moisture. Surface moisture decreases the bulk density of formerly dry coking coal. In order to bring the bulk density of coking coal up to desired value, a widely used procedure is to apply fuel oil to the coal. That fuel oil increases bulk density and, to varying degrees, compensates for the effect of surface moisture.

The use of fuel oil for this purpose, however, suffers from three principal disadvantages. In the first place, not only have fuel oil prices risen dramatically in recent years, thereby increasing costs to undesirable levels, but for various economic and political reasons it is essential that the use of fuel oil be minimized. Eighty to ninety million tons of coal are coked annually by steel companies. Currently, steel companies use No. 2 fuel oil at rates of 2.0–20 pints/ton to adjust the bulk density of coking coal charged to the coke ovens. When the coal has fifteen percent (15%) surface moisture, about two gallons of fuel oil are used per ton of coal. At present, the oil costs something over fifty cents per gallon. Thus, for 15% surface moisture coal, the cost to the steel company is about $1.00/ton. 15% surface moisture is a not too frequent ocurrence, but a figure of 1½ gallons of fuel oil per ton of coal may be a conservative average figure. It is therefore a reasonable estimate that the steel companies use about 150,000,000 gallons of fuel oil per year, at a cost of $75,000,000. Any process which minimizes or eliminates such a use of fuel oil is economically attractive to the steel companies and essential to the country.

In the second place, excessive amounts of fuel oil have been required on wet coal because the wettability of the coal surfaces by oil decreases as the amount of surface moisture increases. Hence, for those coals most in need of bulk density increase, i.e., those coals which have the greatest amount of surface moisture, the amounts of fuel oil that must be used are quite high.

In the third place, if coal has been oxidized, it does not respond as satisfactorily to the fuel oil treatment. Some of the coal produced from strip mining and included in coking coal blends has been exposed to the weathering action of the environment over thousands of years, which causes such oxidation.

Only bituminous coals produce cokes of suitable properties, but not all bituminous coals will do so. Since it is difficult to find a single coal having all of the requisite properties, it is general practice to blend two or more coals into a mix which will perform satisfactorily in the oven and produce a quality coke. Because of the vast quantities of coking coal that are required, coal is piled and stored at coking plants until it is needed. These piles of coal are subjected to the weather and, particularly, to rain, to a greater or lesser degree, and hence it is virtually inevitable that the coal particles will have a relatively high amount of surface moisture thereon, sometimes as much as fifteen percent by weight, and, as has been explained, the existence of such surface moisture not only generally decreases the bulk density the coal but also increases in a greater than linear relationship the amount of fuel oil that must be used to counteract the deleterious effect of the surface moisture.

There is another characteristic of coking coal which is an important industrial consideration, and that is its ability to be moved through equipment, a characteristic often termed "throughput". The better the throughput characteristic of a given mass of coking coal, the more readily will it move through the appropriate equipment, and hence, the less energy will be required to move it therethrough. As the surface moisture of the coal increases, throughput decreases, a not unexpected result—dry coal flows freely, but wet coal does not. When fuel oil is added to coking coal with a high moisture content, although the coking characteristics of that coal are improved, the addition of fuel oil generally aggravates the lessened throughput characteristic produced by the surface moisture. In other words, from a throughput point of view, the addition of fuel oil to coking coal with high surface moisture appears to make a bad situation worse. Hence, any procedure which will improve bulk density of moist coking coal without also decreasing its throughput capacity would be highly desirable.

I have discovered that when suitable combinations of surfactants and other specific substances are added to coking coal, the amounts of fuel oil required to produce coals of requisite bulk density are greatly decreased, and, if certain solid lubricating substances are used, the fuel oil may be dispensed with completely. Moreover, this method results in a marked improvement in the throughput characteristic for the coking coal.

Thus, the need for fuel conservation is satisfied, the throughput characteristic of the coking coal is improved, thereby further reducing energy consumption, and the entire process is less expensive than the prior art process, all without any sacrifice in the operative characteristics of the coal insofar as the production of good coke is concerned. To achieve energy conservation without any sacrifice in overall process efficiency, and to do that with an actual saving of money, is no mean task.

It is a prime object of the present invention to provide a method for enhancing the bulk density of coking coal, and particularly, such coal having surface moisture thereon, which minimizes, and hopefully eliminates, the need for using scarce, expensive and strategically valuable fuel oil for that purpose.

It is a further object of the present invention to provide such a procedure which will also improve the throughput characteristics of the coal.

It is yet another object of the present invention to provide such a procedure which will be no more costly, and hopefully less costly, than the prior art procedures used to accomplish the same result.

It is an additional object of the present invention to provide compositions of material which can be added to coking coals to improve their bulk density and throughput characteristics.

To those ends, and in accordance with the present invention, the particles of the coal in question, either when they are in a pile or, preferably, while they are being transported to the place where they are to be piled or stored, are treated with a material which includes a surfactant having a chain of ten or more carbon atoms and having the characteristic of increasing the spreading coefficient of a second component of the treatment material. In some instances, that second component is fuel oil, used in lesser amount than in the prior art, in which case the surfactant should be oil-soluble and should have the characteristic of increasing the spreading coefficient of the fuel oil. In other instances, fuel oil can be eliminated entirely and substituted by water as the second component, in which case the surfactant should be water-soluble and should have the characteristic of increasing the spreading coefficient of water. When the second component is fuel oil, an alcohol is preferably included in the treatment material. When the second component is water, an inorganic lubricating substance, such as fumed silica, formed of very small substantially rounded, substantially solid particles, is employed. Sufficient of this treatment material is applied to the coal to produce the desired bulk density and to enhance the throughput characteristic of the coal.

To the accomplishment of the above, and to such other objects as may hereinafter appear, the present invention relates to a method of improving the bulk density and throughput characteristics of coking coal, and to a composition of material to be used to that end, as defined in the appended claims, and as described in this specification.

There are many variables involved in evaluating the suitability of bituminous coal for coking purposes. One coal varies from another in physical characteristics and chemical composition. A given type of coal may vary in its coking effectiveness, depending upon the length of time that it has been permitted to stand in the presence of oxygen, the degree to which it has been exposed to moisture and rain, etc. Moreover, most coals actually used for coking represent a blend of different types of coal. Accordingly, it is very difficult to generalize as to the specific compositions and proportions of material appropriate to produce a given bulk density or throughput characteristic for coking coal under a given set of conditions. Even with coals of substantially the same surface moisture content, specific treatment materials may differ and specific materials proportions may differ. Accordingly, for any given instance, some experimentation may be required to determine, from the categories of materials here set forth, which particular material or combination of materials, and which proportions of those materials, will give optimum results.

The main operative constituent for the treatment material here disclosed is a surfactant. The term "surfactant" is here used to mean a substance having the property of lowering surface tension and increasing the spreading coefficient of the second component of the treatment material, which may be either fuel oil or water. If the second component is fuel oil, the surfactant should be oil-soluble, while if the second component is water, the surfactant should be water-soluble. The oil-soluble surfactant increases the spreading coefficient of the fuel oil, and the water-soluble surfactant increases the spreading coefficient of the water.

The treatment material of the present invention, as here specifically disclosed, preferably includes a third component. When some fuel oil is employed in the treatment material along with an oil-soluble surfactant, the third component is an alcohol, and preferably such an alcohol selected from the group consisting of those having from 1–8 carbon atoms in their chain. When the treatment material comprises water and a water-soluble surfactant, the third component is an inorganic lubricating substance formed of substantially rounded, substantially solid particles, the bulk of which pass a screen of about 325 mesh, fumed silica being such a substance.

Because of the wide variations in available coking coals, and because of the difficulty involved in making quantitative analyses of the effectiveness of various treatment materials under actual coking furnace conditions, an experimental technique was developed to analyze and evaluate the effectiveness of the materials and the procedures involved in the present invention. In order to determine bulk densities, a commercial compressibility tester was employed. In order to measure the throughput, or bulk handling, properties of the coal, a hammermill grinder was used to simulate the pulverization process.

For evaluating bulk density, a homogeneous 30- to 50-gram sample of coal ($\frac{1}{4}\times 0$ max.) is placed in a test cell of known volume. Pressure is applied to the lid of the sample container by means of weights suspended from a hanger set. The downward motion of the lid and, hence, the volume compression, is measured by means of the deflection (H) on a dial indicator as a function of compacting weight. The bulk density $\gamma$ at various loads (0.5, 1.5, 3.5, 10.5, 20.5, 40.5, and 80.5 lbs) is computed as:

$$\gamma = 0.775 \frac{\text{Net Wt.}}{H_{(in)}} \ (\text{lb/ft}^3)$$

For the sake of brevity, only uncompacted (0 lbs., 0 p.s.i.) and compacted (80.5 lbs., 16.5 p.s.i.) are reported here. The compacted bulk densities simulate the compaction found as coal is dropped from a larry car into the coke oven. In the charging of coal to the ovens, an 18-ton charge is dropped a distance of perhaps 10 to 15 feet onto the oven floor. Because the coal falls as discrete particles the impulse force exerted upon collision with the oven floor or other coal particles does not result in compaction pressures exceeding much more than perhaps 4 p.s.i. There is, however, a mechanical agitation as the coal particles fall and come to rest which tends to move coal particles more closely together and thereby increases bulk density over and above what one would expect at a compaction pressure of 4 p.s.i. or less.

The compressibility tester is charged with coal in such a way as to minimize this type of mechanical agitation. Uncompacted bulk densities measured in this fashion were found to range between, say, 35 and 45 lbs/ft.$^3$ These values were considerably lower than those reported to be encountered in plant practice. Consequently, some degree of sample compaction was required to compensate for the lack of mechanical agitation.

Thus, the compaction pressure of 16.5 p.s.i. was not chosen arbitrarily. Samples of coking coal were ground and placed gently to overflowing in a canister having a volume of 0.54 ft$^3$ and leveled off with a straight edge. The canister and its contents were weighed in five separate runs to yield a bulk density of 33.94±2.50 lbs./ft.$^3$. The experiment was repeated by dropping coal from a height of six feet into the empty canister. The excess was leveled and the canister and contents weighed on five separate occasions to yield a bulk density of 46.93±0.47 lbs/ft$^3$ corresponding to an increase of 12.99 lbs/ft$^3$.

Ground coking coal was then placed in the compressibility tester and uncompacted bulk density of 37.30 lbs/ft$^3$ (±0.27) was obtained. Increasing amounts of weight were used to compact the sample. The compaction weight or pressure which yielded a net change corresponding to 12.99 lbs/ft$^3$ would be the compaction pressure of choice. However, the maximum compaction pressure of 16.5 p.s.i. attainable with the compressibility test yielded a value of 48.90 lbs/ft$^3$ (±0.09) corresponding to a net change of 11.6 lbs/ft$^3$. Consequently, a compaction pressure of 16.5 p.s.i. was used for all subsequent work unless otherwise indicated. This compaction pressure was found to best duplicate plant experience.

To evaluate throughput, a 12- to 15- lb charge of raw coal is placed in the grinder and ground through a $\frac{1}{4}$-inch screen. The time required for grinding is monitored—usually 30 to 90 seconds—along with the amperage at a constant line voltage of 220 V. In practice, this is accomplished by using an ammeter in combination with a strip chart recorder which provides a plot of amperage vs. time. First a baseline plot is obtained in the absence of coal. The weight of a known area under this curve is determined by a cut-and-weigh method to provide a conversion factor or multiplier in a amp-sec/gram. Coal is charged to the grinder and ground to provide a plot of current vs. time. The total area under this curve is cut out, weighed and multiplied by the above factor to give the total number of amp-secs.

This figure is divided by the grinding time to determine the total amps consumed, which is then multiplied by the line voltage to yield watts (power), i.e.:

$$\text{Power (Watts)} = \frac{\text{Amp-Sec}}{\text{Grinding Time (Sec.)}} \times 220 \text{ volts}$$

To obtain a value of coal throughput, the grinding rate in lbs/sec is divided by power and appropriate conversion factors are used to determine throughput in lb/KwHr, i.e.:

$$\text{Throughput} = \text{Grinding Rate (lb/sec)} \div \text{Power (Watts)} \times 3600 \text{ sec/hr} \div .001 \text{ KwHr/watt-hr}$$

The greater the throughput, the higher the process efficiency.

With respect to bulk density, the effect of each formulation, according to the present invention, has been compared to a conventional fuel oil treatment by means of a performance coefficient defined as $$P = \frac{D_x - D_i}{R}$$

where:

$D_x$ = Bulk density (wet basis) measured for additive X treatment $D_i$ = Bulk density (wet basis) of untreated control R = Treatment rate, pints/ton.

Thus, the ratios of performance coefficients can be used to calculate percentage improvements, i.e., $$\% \text{ Improvement} = \frac{P_x - P_F}{P_F} \times 100\%$$

where:

$P_x$ = Performance coefficient of additive X $P_F$ = Performance coefficient of fuel oil at equivalent treatment rates.

All reported bulk density results were the average of triplicate runs. The standard deviation on a set of 72 representative data points was calculated to be 0.22 lbs yielding a percent probable error of about 0.05% in bulk density values.

Unless otherwise indicated in the tables or elsewhere in this specification, all additives to fuel oil and combinations thereof were mixed with a No. 2 fuel at 10% by weight.

The initial bulk density tests were made on individual coking coals, as indicated. These coals were supplied by a major steel producer.

In those treatment materials which still contain fuel oil, although in significantly lower proportions than had previously been thought to be necessary, the use of oil-soluble surfactants appears generally to enhance the bulk-density-increasing action of the fuel oil, but in general, only when the surfactant is present in such quantities as to make the treatment material economically undesirable. However, when one adds to the treatment material an alcohol, and preferably one having a relatively short carbon chain—from 1–8 carbon atoms—the amount of surfactant needed to produce the desired bulk-density-increasing result is greatly reduced, for a given low fuel oil content, thereby making the treatment material even less costly then fuel oil alone.

Because of availability and cost, certain oil-soluble surfactants having a chain of 10 or more carbon atoms, and certain alcohols, have been found to be particularly desirable. For the surfactants, long chain primary and secondary alcohols and alkylaryl sulfonates, such as the non-ionic mixture of ethoxylated secondary alcohols having from 11 to 15 carbon atoms in the chain, sold under the tradename of TERGITOL 15S7, and the alkylaryl sulfonate sold under the tradename WITCONATE P1059, have been found to be particularly desirable, as has that mixture of primary alcohols having chain lengths from 14 to 18 carbon atoms, sold under the tradename "Harchemex". Among the alcohols isopropyl and octyl alcohols have been found to be particularly appropriate. The combination of alcohol and oil-soluble surfactant appears to have a synergistic effect on improving bulk density, an effect considerably greater than would be expected by adding the effects produced when the surfactant and the alcohol are used individually along with the fuel oil.

For the fuel-oil-containing embodiment, the proportions by weight of fuel oil can be as low as 50% and as high as 99%, (although, for reasons already advanced, minimization of the fuel oil content is highly desired) with the remainder of the treatment material being present in proportions between 50% and 1%. That remainder, in turn, comprises in approximate proportions by weight, surfactant 50–99% and alcohol 50–1%. Within those broad ranges, as at present advised, the proportions by weight of fuel oil preferably are between 85–95%, with said remainder, in turn, preferably comprising surfactant 70–95% and alcohol 30–5%. A particularly effective formulation involves 90% fuel oil and 10% remainder, with said remainder comprising 90% surfactant and 10% alcohol.

In that embodiment where no fuel oil is employed, the water-soluble surfactant there used has a chain of 10 or more carbon atoms, with linear alcohols and alkylaryl sulfonates giving excellent results. A typical linear alcohol is that mixture of ethoxylated secondary alcohols having from 11 to 15 carbon atoms in the chain, sold under the trade name Tergitol 1557. In these non-fuel oil containing formulations, the surfactant may be present in proportions by weight between 0.1 and 30%, the solid lubricating substance 1–20%, and the balance substantially all water, with surfactant proportions of 1–15% and lubricating substance proportions of 1–3% being preferred. A particularly effective formulation utilizes about 10% surfactant and about 1% lubricating substance, with the balance substantially all water.

With respect to the lubricating substance used in conjunction with the non-fuel-oil-containing treatment materials, fumed silica, such as that sold under the tradename "AEROSIL 200", which is an inorganic substance formed of substantially rounded, substantially solid particles, the bulk of which pass a screen of about 325 mesh, has been found to be particularly effective. In connection with that material, it is generally recognized that fine particulates having appropriate size and surface chemistry can be added to bulk solids to substantially alter their handling properties. It is thought that the particular material can act as small roller bearings which promote the freer flow of material. Additionally, such particulate can have a profound effect upon surface wettability. However, the use of fumed silica alone appears to have little or no effect on bulk density improvement. Neither does the addition of fumed silica to the fuel-oil-containing formulations of the present invention. However, the addition of 1% AEROSIL 200 to a 20% aqueous solution of TERGITOL 15S7 results in a dramatic improvement, particularly in compacted bulk density. In comparison to the same solution containing no AEROSIL 200, performance is essentially doubled. Indeed, the effect of the addition of fumed silica on aqueous surfactant solutions is so considerable that the combination appears to be economically viable as a complete substitute for fuel oil. It is noteworthy that the addition of the fumed silica results in high performance even at lower (3%) moisture contents—a phenomenon not previously observed with other aqueous formulas.

The amount of treatment material required per ton of coal will vary considerably from coal to coal and with changes in surface moisture content of a given coal. Present indications are that a minimum of about one pint/ton is needed for significant bulk density improvement, with a maximum value of about 10 pints per ton dictated primarily by economic considerations.

Referring to Section A of Table I (below), all of six surfactants studied initially resulted in performance coefficients higher than conventional fuel oil treatments with improvements ranging between 6.2 and 59.4% for Tween 81 and Witconol Apem, respectively.

Oleic acid was chosen for further study due to the fact it gave the greatest improvement in compacted bulk density (208%). As shown in Section B of Table I, the improvement in the ability of fuel oil to increase bulk density of −16 mesh Corbin coal was proportional to the concentration of additive over the range of 0–10% by weight. At 10% by weight of oleic acid an average percentage improvement of 109% was obtained. However, when the fuel oil/oleic acid combination was tested on $\frac{1}{4}\times 0$ Concord coal with 85% of the particles between $\frac{1}{8}''$ at four different treatment rates, performance improvements were less defined as shown by an inspection of Table I, Section C. Performance was inconsistent, scattered, and poor on wetter coal.

Consequently, additional surfactants were tried on Concord coal as indicated in Section D of Table I. In no case did a fuel oil/surfactant formulation yield an average performance coefficient higher than fuel oil alone. The following surfactants did, however, give significant improvements in performance coefficients at maximum bulk density.

a. Shercomid 0DA
b. Witconate 605A
C. Emery 531
d. Witconate P1059

As shown in Section E of Table I, the addition of 5% methyl alcohol reduced the compressibilities in combination with each of the four surfactants, excepting Witconate 605A. In addition, performance coefficients increased dramatically. For example, with fuel oil alone the compressibility was 0.173 with a performance coefficient of 0.14. When methyl alcohol was added to Witconate P1059, Emery 531 and Shercomid 0DA compressibilities decreased to 0.45, 0.22 and 0.44, respectively. These are examples of high performance formulations yielding compressibilities lower than fuel oil treated controls.

Section F of Table I shows that alcohol alone gave no increase in performance coefficient (but compare item 6 in Section E).

Section G of Table I is to some extent inconsistent with the results set forth in Section D, and illustrates the sporadic nature of the effects of using surfactants alone.

Low molecular weight alcohols alone or in combination with one another had no measurable effect upon bulk density. Principally on the basis of cost considerations, isopropyl alcohol was selected for further work. As shown in Section H of Table I, the addition of 5% by weight IPA to fuel oil containing 10% by weight surfactant resulted in average performance coefficients five to eight times higher than fuel oil alone. Only in the case of Witconate P1059, however, was compressibility reduced below that of the fuel oil control. This formulation, incidentally, gave the highest performance coefficients.

Section I of Table 1 shows that best results were obtained when a mixture of 90% Witconate P1059 and 10% IPA was added to fuel oil at 10% by weight.

Although Witconate P1059/IPA mixtures performed well, they suffered from two disadvantages:

a. High cost
b. Witconate P1059 and IPA are immiscible at the optimal 90/10 ratio and had to be added separately to fuel oil.

Consequently, Tergitol 15S7 was selected for further study since it was found to be miscible in all proportions with isopropyl alcohol and represented one of the least expensive synthetic surfactants available.

In Table I, sections J through L, experimental results demonstrated that a 90/10 Tergitol 15S7/IPA mixture either equaled or exceeded the Witconate P1059/IPA mixture on both Corbin and Wellington coals. Best performance was obtained with Tergitol 15S7 containing 10 to 20% isopropyl alcohol.

Since Tergitol 15S7 is an ethoxylated linear alcohol, it was felt that further reductions in raw material cost might be achieved by using a mixture of primary alcohols. Consequently, a sample of "Harchemex" consisting of a mixture of $C_{14}$ to $C_{18}$ alcohols was obtained from Union Camp. In addition, octyl alcohol was evaluated since it represented a relatively low selling price in bulk quantities.

As shown in Table I, Section M, octyl alcohol, when added to fuel oil, had no significant effect upon performance. Harchemex alone resulted in a substantial improvement yielding an average performance coefficient of 0.54 compared to 0.16 for a fuel oil treated control. Best results were obtained for a 50/50 mixture of Harchemex and octyl alcohol with a performance coefficient of 0.76. The ratio of Harchemex to octyl alcohol was optimized on Maple Creek and Altheus coals as shown in sections M and N of Table I. In both cases, highest performance coefficients were obtained for mixtures containing 80–90% Harchemex and 20–10% octyl alcohol. It is also observed that the blends of Harchemex and octyl alcohol on Altheus coal gave performance equivalent to the Witconate P1059, IPA blend. Isopropyl alcohol was not used in combination with Harchemex due to its poor solubility.

Based on these tests, it appears that the following formulations are preferred on the basis of performance and cost:

a. Witconate P1059 (90%), IPA (10%)
b. Tergitol 15S7 (90%), IPA (10%)
c. Harchemex (90%), Octyl alcohol (10%)

TABLE I

| Treatment | Treatment Rate (pints/ton) | Surface Moisture (%) | Bulk Density lb/ft³(W.B.) Max. | Bulk Density lb/ft³(W.B.) Min. | B | P Performance Code Max. | P Performance Code Min. | P Performance Code Avg. |
|---|---|---|---|---|---|---|---|---|
| A. Corbin Coal, −16 Mesh | | | | | | | | |
| 1. None | — | 10 | 47.64 | 36.06 | 0.146 | — | — | — |
| 2. Fuel Oil | 4 | 10 | 48.01 | 38.12 | 0.125 | 0.12 | 0.51 | 0.32 |
| 3. Tween 81 | 4 | 10 | 48.58 | 37.81 | 0.136 | 0.24 | 0.44 | 0.34 |
| 4. Witcamide 511 | 4 | 10 | 48.95 | 38.09 | 0.137 | 0.33 | 0.51 | 0.42 |
| 5. Emsorb 6909 | 4 | 10 | 48.95 | 37.99 | 0.138 | 0.33 | 0.48 | 0.41 |
| 6. Tergitol 15S7 | 4 | 10 | 48.53 | 37.99 | 0.133 | 0.22 | 0.48 | 0.35 |
| 7. Witconol APEM | 4 | 10 | 48.94 | 38.89 | 0.127 | 0.32 | 0.70 | 0.51 |
| 8. Oleic Acid | 4 | 10 | 49.13 | 38.11 | 0.139 | 0.37 | 0.51 | 0.44 |

TABLE I-continued

| Treatment | Treatment Rate (pints/ton) | Surface Moisture (%) | Bulk Density lb/ft$^3$(W.B.) Max. | Min. | B | P Performance Code Max. | Min. | Avg. |
|---|---|---|---|---|---|---|---|---|
| B. Corbin Coal, -16 Mesh | | | | | | | | |
| 1. None | — | 10 | 46.95 | 35.48 | 0.146 | — | — | — |
| 2. Fuel Oil | 4 | 10 | 47.60 | 36.51 | 0.140 | 0.16 | 0.26 | 0.21 |
| 3. Oleic Acid(2% W/W) | 4 | 10 | 47.93 | 36.81 | 0.141 | 0.25 | 0.33 | 0.29 |
| 4. Oleic Acid(4% W/W) | 4 | 10 | 48.27 | 37.17 | 0.141 | 0.33 | 0.42 | 0.38 |
| 5. Oleic Acid(6%) | 4 | 10 | 48.15 | 37.13 | 0.139 | 0.30 | 0.41 | 0.36 |
| 6. Oleic Acid(8% W/W) | 4 | 10 | 48.57 | 37.25 | 0.143 | 0.41 | 0.44 | 0.42 |
| 7. Oleic Acid(10% W/W) | 4 | 10 | 48.61 | 37.32 | 0.142 | 0.42 | 0.46 | 0.44 |
| C. Concord Coal, ¼ × 0.85% - ⅛" | | | | | | | | |
| 1. None | — | 0 | 54.86 | 53.01 | 0.023 | — | — | — |
| 2. None | — | 4 | 52.73 | 42.07 | 0.135 | — | — | — |
| 3. Fuel Oil | 2 | 4 | 53.85 | 47.03 | 0.086 | 0.56 | 2.48 | 1.52 |
| 4. " | 4 | 4 | 53.87 | 47.77 | 0.077 | 0.28 | 1.43 | 0.81 |
| 5. " | 6 | 4 | 54.68 | 48.44 | 0.079 | 0.32 | 1.06 | 0.69 |
| 6. " | 8 | 4 | 54.36 | 48.38 | 0.076 | 0.20 | 0.79 | 0.50 |
| 7. Oleic Acid | 2 | 4 | 54.91 | 48.03 | 0.087 | 1.09 | 2.98 | 2.04 |
| 8. " | 4 | 4 | 54.70 | 47.29 | 0.094 | 0.49 | 1.31 | 0.90 |
| 9. " | 6 | 4 | 55.49 | 49.74 | 0.073 | 0.46 | 1.28 | 0.87 |
| 10. " | 8 | 4 | 54.38 | 48.21 | 0.078 | 0.21 | 0.77 | 0.49 |
| 11. None | — | 6 | 52.94 | 40.31 | 0.159 | — | — | — |
| 12. Fuel Oil | 2 | 6 | 53.85 | 44.94 | 0.112 | 0.46 | 2.32 | 1.39 |
| 13. " | 4 | 6 | 54.25 | 47.57 | 0.085 | 0.33 | 1.81 | 1.07 |
| 14. " | 6 | 6 | 55.16 | 48.32 | 0.087 | 0.37 | 1.34 | 0.86 |
| 15. " | 8 | 6 | 54.51 | 47.74 | 0.086 | 0.20 | 0.93 | 0.57 |
| 16. Oleic Acid | 2 | 6 | 53.70 | 42.02 | 0.148 | 0.38 | 0.85 | 0.62 |
| 17. Oleic Acid | 4 | 6 | 54.55 | 43.69 | 0.137 | 0.40 | 0.85 | 0.63 |
| 18. " | 6 | 6 | 54.30 | 44.73 | 0.121 | 0.23 | 0.74 | 0.49 |
| 19. " | 8 | 6 | 54.88 | 45.50 | 0.119 | 0.24 | 0.65 | 0.45 |
| 20. None | — | 8 | 53.65 | 40.03 | 0.172 | — | — | — |
| 21. Fuel Oil | 2 | 8 | 53.83 | 40.87 | 0.164 | 0.09 | 0.42 | 0.26 |
| 22. " | 4 | 8 | 55.28 | 45.15 | 0.128 | 0.81 | 1.28 | 1.05 |
| 23. " | 6 | 8 | 55.36 | 46.89 | 0.107 | 0.85 | 1.14 | 1.05 |
| 24. " | 8 | 8 | 55.46 | 47.05 | 0.106 | 0.91 | 0.88 | 0.89 |
| 25. Oleic Acid | 2 | 8 | 54.53 | 41.05 | 0.171 | 0.44 | 0.51 | 0.48 |
| 26. " | 4 | 8 | 54.61 | 41.78 | 0.162 | 0.24 | 0.44 | 0.34 |
| 27. " | 6 | 8 | 55.20 | 43.26 | 0.151 | 0.23 | 0.54 | 0.39 |
| 28. " | 8 | 8 | 55.47 | 43.59 | 0.151 | 0.23 | 0.45 | 0.34 |
| 29. None | — | 10 | 54.44 | 40.88 | 0.171 | — | — | — |
| 30. Fuel Oil | 2 | 10 | 54.94 | 42.00 | 0.163 | 0.25 | 0.56 | 0.41 |
| 31. " | 4 | 10 | 55.35 | 43.39 | 0.151 | 0.23 | 0.63 | 0.43 |
| 32. " | 6 | 10 | 56.18 | 46.72 | 0.119 | 0.29 | 0.97 | 0.63 |
| 33. " | 8 | 10 | 56.27 | 45.87 | 0.132 | 0.23 | 0.62 | 0.43 |
| 34. Oleic Acid | 2 | 10 | 55.21 | 41.93 | 0.168 | 0.39 | 0.53 | 0.46 |
| 35. " | 4 | 10 | 55.69 | 42.55 | 0.166 | 0.31 | 0.42 | 0.36 |
| 36. " | 6 | 10 | 55.62 | 41.99 | 0.172 | 0.19 | 0.18 | 0.19 |
| 37. Oleic Acid | 8 | 10 | 55.98 | 42.59 | 0.169 | 0.19 | 0.21 | 0.20 |
| 38. None | — | 12 | 55.70 | 40.81 | 0.188 | — | — | — |
| 39. Fuel Oil | 2 | 12 | 55.92 | 41.64 | 0.181 | 0.11 | 0.42 | 0.27 |
| 40. " | 4 | 12 | 56.95 | 42.90 | 0.178 | 0.31 | 0.52 | 0.42 |
| 41. " | 6 | 12 | 57.22 | 46.57 | 0.135 | 0.25 | 0.96 | 0.79 |
| 42. " | 8 | 12 | 57.09 | 46.65 | 0.132 | 0.27 | 0.73 | 0.50 |
| 43. Oleic Acid | 2 | 12 | 55.79 | 41.61 | 0.179 | 0.05 | 0.40 | 0.23 |
| 44. " | 4 | 12 | 56.63 | 42.22 | 0.182 | 0.23 | 0.35 | 0.29 |
| 45. " | 6 | 12 | 56.78 | 42.52 | 0.181 | 0.18 | 0.29 | 0.24 |
| 46. " | 8 | 12 | 56.46 | 43.18 | 0.168 | 0.10 | 0.30 | 0.20 |
| D. Concord Coal, ¼ × 0, 85% - ⅛" | | | | | | | | |
| 1. None | — | 10 | 54.89 | 41.25 | 0.172 | — | — | — |
| 2. Fuel Oil | 4 | 10 | 56.06 | 43.93 | 0.153 | 0.29 | 0.67 | 0.48 |
| 3. Shercomid ODA | 4 | 10 | 56.40 | 43.58 | 0.162 | 0.38 | 0.58 | 0.48 |
| 4. Oleic Acid | 4 | 10 | 55.69 | 42.55 | 0.166 | 0.20 | 0.33 | 0.27 |
| 5. Shercomid CDA | 4 | 10 | 55.95 | 42.40 | 0.172 | 0.27 | 0.29 | 0.28 |
| 6. Witconate 605A | 4 | 10 | 56.40 | 42.95 | 0.170 | 0.38 | 0.43 | 0.41 |
| 7. Emery 531 | 4 | 10 | 45.52 | 42.64 | 0.176 | 0.41 | 0.35 | 0.36 |
| 8. Emsorb 2500 | 4 | 10 | 55.74 | 52.67 | 0.165 | 0.21 | 0.36 | 0.29 |
| 9. Emsorb 2503 | 4 | 10 | 55.91 | 43.39 | 0.158 | 0.26 | 0.54 | 0.40 |
| 10. Emsorb 6903 | 4 | 10 | 55.63 | 42.43 | 0.167 | 0.19 | 0.30 | 0.24 |
| 11. Emsorb 6905 | 4 | 10 | 55.87 | 42.40 | 0.170 | 0.25 | 0.29 | 0.27 |
| 12. Trylox 6747 | 4 | 10 | 56.16 | 42.69 | 0.167 | 0.32 | 0.43 | 0.38 |
| 13. Emid 6545 | 4 | 10 | 56.04 | 43.50 | 0.158 | 0.29 | 0.56 | 0.43 |
| 14. Witconate P1059 | 4 | 10 | 56.49 | 43.50 | 0.164 | 0.40 | 0.56 | 0.48 |
| E. Concord Coal, ¼ × 0, 85% - ⅛ Mesh | | | | | | | | |
| 1. None | — | 10 | 54.70 | 40.68 | 0.177 | — | — | — |
| 2. Fuel Oil | 4 | 10 | 55.09 | 41.41 | 0.173 | 0.10 | 0.18 | .14 |
| 3. Emery 531(10%) Methanol (5%) Fuel Oil(85%) | 4 | 10 | 55.14 | 41.99 | 0.166 | 0.11 | 0.33 | .22 |
| 4. Witconate 605A(10%) Methanol (5%) | | | | | | | | |

TABLE I-continued

| Treatment | Treatment Rate (pints/ton) | Surface Moisture (%) | Bulk Density lb/ft³(W.B.) Max. | Min. | B | P Performance Code Max. | Min. | Avg. |
|---|---|---|---|---|---|---|---|---|
| Fuel Oil(85%) | 4 | 10 | 55.69 | 41.30 | 0.182 | 0.25 | 0.16 | .21 |
| 5. Shercomid ODA(10%) Methanol(5%) Fuel Oil(85%) | 4 | 10 | 55.63 | 43.27 | 0.156 | 0.23 | 0.65 | .44 |
| 6. Methanol(5%) Fuel Oil(95%) | 4 | 10 | 55.90 | 41.73 | 0.179 | 0.30 | 0.26 | .28 |
| 7. Witconate P1059(10%) Methanol(5%) Fuel Oil(95%) | 4 | 10 | 55.85 | 43.10 | 0.161 | 0.29 | 0.61 | .45 |
| F. Concord Coal, ¼ × 0, 85% - ⅛ Mesh | | | | | | | | |
| 1. None | — | 10 | 55.36 | 41.20 | 0.179 | — | — | — |
| 2. Fuel Oil | 4 | 10 | 55.51 | 41.67 | 0.175 | 0.04 | 0.12 | 0.08 |
| 3. Ethanol(10%) Fuel Oil(90%) | 4 | 10 | 55.71 | 41.20 | 0.183 | 0.09 | 0.0 | 0.04 |
| 4. Ethanol(100%) | 4 | 10 | 55.40 | 41.63 | 0.174 | 0.01 | 0.11 | 0.06 |
| G. Concord Coal, ¼ × 0, 85% - ⅛ Mesh | | | | | | | | |
| 1. None | — | 10 | 55.21 | 41.53 | 0.173 | — | — | — |
| 2. Fuel Oil | 4 | 10 | 55.80 | 41.25 | 0.184 | 0.15 | −0.07 | 0.04 |
| 3. RW 50 | 4 | 10 | 55.85 | 43.01 | 0.162 | 0.16 | 0.37 | 0.27 |
| 4. Trymeen TAM 8 | 4 | 10 | 56.10 | 43.24 | 0.162 | 0.22 | 0.43 | 0.33 |
| 5. Shercomid ODA | 4 | 10 | 55.20 | 43.16 | 0.158 | 0.12 | 0.41 | 0.27 |
| 6. Emery 531 | 4 | 10 | 55.50 | 42.54 | 0.164 | 0.07 | 0.25 | 0.16 |
| 7. Witconate 605A | 4 | 10 | 55.44 | 43.21 | 0.155 | 0.06 | 0.42 | 0.24 |
| 8. Witconate P1059 | 4 | 10 | 56.22 | 43.69 | 0.159 | 0.25 | 0.54 | 0.40 |
| 9. Tergitol 15S7 | 4 | 10 | 55.92 | 43.22 | 0.160 | 0.18 | 0.42 | 0.30 |
| H. Concord Coal, ¼ × 0, 85% - ⅛ Mesh | | | | | | | | |
| 1. None | — | 10 | 54.92 | 41.79 | 0.166 | — | — | — |
| 2. Fuel Oil | 4 | 10 | 54.86 | 42.40 | 0.157 | −0.02 | 0.15 | 0.07 |
| 3. RW 50(10%) IPA(5%) Fuel Oil(85%) | 4 | 10 | 56.32 | 43.07 | 0.167 | 0.35 | 0.32 | 0.34 |
| 4. Trymeen TAM8(10%) IPA(5%) Fuel Oil(85%) | 4 | 10 | 56.63 | 43.90 | 0.161 | 0.43 | 0.53 | 0.48 |
| 5. Shercomid ODA(10%) IPA (5%) Fuel Oil (85%) | 4 | 10 | 56.28 | 42.96 | 0.168 | 0.34 | 0.29 | 0.32 |
| 6. Witconate P1059(10%) IPA(5%) Fuel Oil(85%) | 4 | 10 | 56.24 | 44.90 | 0.144 | 0.33 | 0.77 | 0.55 |
| 7. Witconate 605A(10%) IPA(5%) Fuel Oil(85%) | 4 | 10 | 55.79 | 42.66 | 0.166 | 0.22 | 0.22 | 0.22 |
| 8. Emery 531(10%) IPA(5%) Fuel Oil(85%) | 4 | 10 | 55.45 | 42.18 | 0.168 | 0.13 | 0.10 | 0.12 |
| I. Maple Creek, ¼ × 0, 85% - ⅛ Mesh | | | | | | | | |
| 1. None | 4 | 10 | 51.91 | 41.03 | 0.137 | — | — | — |
| 2. Fuel Oil | 4 | 10 | 52.45 | 41.47 | 0.140 | 0.14 | 0.11 | 0.13 |
| 3. Witconate P1059 | 4 | 10 | 52.04 | 41.33 | 0.136 | 0.03 | 0.10 | 0.06 |
| 4. Witconate P1059(90%) IPA(10%) | 4 | 10 | 53.22 | 43.50 | 0.122 | 0.33 | 0.64 | 0.48 |
| 5. Witconate P1059(80%) IPA(20%) | 4 | 10 | 53.07 | 42.75 | 0.131 | 0.29 | 0.43 | 0.36 |
| 6. Witconate P1059(70%) IPA(30%) | 4 | 10 | 52.87 | 41.98 | 0.138 | 0.24 | 0.24 | 0.24 |
| 7. Witconate P1059(60%) IPA(40%) | 4 | 10 | 52.65 | 41.64 | 0.139 | 0.19 | 0.15 | 0.17 |
| 8. Witconate P1059(40%) IPA(60%) | 4 | 10 | 52.76 | 41.43 | 0.143 | 0.21 | 0.10 | 0.16 |
| 9. Witconate P1059(20%) IPA(80%) | 4 | 10 | 52.63 | 41.66 | 0.139 | 0.18 | 0.16 | 0.17 |
| 10. IPA(100%) | 4 | 10 | 52.04 | 41.33 | 0.136 | 0.03 | 0.08 | 0.06 |
| J. Maple Creek, ¼ × 0, 85% - ⅛ Mesh | | | | | | | | |
| 1. None | — | 10 | 51.65 | 41.25 | 0.132 | — | — | — |
| 2. Fuel Oil | 4 | 10 | 51.68 | 40.22 | 0.145 | 0.01 | −0.26 | −0.12 |
| 3. Tergitol 15S7 | 4 | 10 | 52.58 | 42.14 | 0.132 | 0.23 | 0.23 | 0.23 |
| 4. Witconate P1059 | 4 | 10 | 52.27 | 42.57 | 0.123 | 0.16 | 0.33 | 0.25 |
| 5. Tergitol 15S7(90%) IPA(10%) | 4 | 10 | 52.64 | 41.99 | 0.135 | 0.25 | 0.19 | 0.22 |
| 6. Tergitol 15S7(80%) IPA(20%) | 4 | 10 | 52.44 | 42.24 | 0.129 | 0.20 | 0.25 | 0.22 |
| 7. Tergitol 15S7(60%) IPA(40%) | 4 | 10 | 51.98 | 41.42 | 0.134 | 0.08 | 0.04 | 0.06 |
| 8. Tergitol 15S7(50%) IPA(50%) | 4 | 10 | 52.20 | 42.10 | 0.128 | 0.14 | 0.21 | 0.18 |
| 9. Witconate P1059(90%) | | | | | | | | |

TABLE I-continued

| Treatment | Treatment Rate (pints/ton) | Surface Moisture (%) | Bulk Density lb/ft³(W.B.) Max. | Min. | B | P Performance Code Max. | Min. | Avg. |
|---|---|---|---|---|---|---|---|---|
| IPA(10%) | 4 | 10 | 52.89 | 43.72 | 0.116 | 0.31 | 0.62 | 0.47 |
| 10. Petromix 9 | 4 | 10 | 51.99 | 41.12 | 0.138 | 0.09 | −0.03 | 0.03 |
| 11. Zonyl FSP | 4 | 10 | 50.99 | 40.77 | 0.129 | −0.17 | −0.12 | −0.15 |
| 12. Zonyl ESB | 4 | 10 | 51.15 | 41.38 | 0.124 | −0.13 | −0.03 | −0.08 |
| 13. Zonyl FSA | 4 | 10 | 51.38 | 40.27 | 0.141 | −0.07 | −0.25 | −0.16 |
| K. Corbin Coal, ¼ × 0, 85% - ⅛ Mesh | | | | | | | | |
| 1. None | — | 2.4 | 50.78 | 44.97 | 0.074 | — | — | — |
| 2. Fuel Oil | 2 | 2.4 | 51.89 | 47.21 | 0.059 | 0.28 | 0.56 | 0.42 |
| 3. Fuel Oil | 4 | 2.4 | 51.97 | 47.23 | 0.060 | 0.30 | 0.57 | 0.38 |
| 4. P1059(90%), IPA(10%) | 2 | 2.4 | 51.75 | 47.14 | 0.058 | 0.24 | 0.54 | 0.19 |
| 5. " | 4 | 2.4 | 51.85 | 46.79 | 0.064 | 0.27 | 0.46 | 0.37 |
| 6. 15S7(90%), IPA(10%) | 2 | 2.4 | 52.10 | 47.89 | 0.053 | 0.33 | 0.76 | 0.55 |
| 7. " | 4 | 2.4 | 51.93 | 47.44 | 0.056 | 0.29 | 0.62 | 0.46 |
| 8. None | — | 5 | 50.61 | 41.77 | 0.112 | — | — | — |
| 9. Fuel Oil | 2 | 5 | 50.74 | 42.50 | 0.104 | 0.07 | 0.36 | 0.22 |
| 10. " | 4 | 5 | 50.69 | 43.55 | 0.090 | 0.02 | 0.45 | 0.24 |
| 11. 1059(90%), IPA(10%) | 2 | 5 | 50.61 | 42.74 | 0.099 | 0.00 | 0.49 | 0.25 |
| 12. " | 4 | 5 | 50.68 | 43.04 | 0.097 | 0.02 | 0.32 | 0.17 |
| 13. 15S7(90%), IPA(10%) | 2 | 5 | 50.54 | 42.27 | 0.105 | −0.03 | 0.25 | 0.11 |
| 14. " | 4 | 5 | 50.83 | 43.45 | 0.813 | 0.05 | 0.42 | 0.24 |
| 15. None | — | 10 | 50.46 | 40.45 | 0.127 | — | — | — |
| 16. Fuel Oil | 2 | 10 | 51.24 | 41.12 | 0.128 | 0.38 | 0.33 | 0.35 |
| 17. " | 4 | 10 | 51.29 | 40.86 | 0.132 | 0.21 | 0.10 | 0.16 |
| 18. 1059(90%), IPA(10%) | 2 | 10 | 51.85 | 42.18 | 0.122 | 0.69 | 0.81 | 0.75 |
| 19. " | 4 | 10 | 51.89 | 43.48 | 0.107 | 0.71 | 0.73 | 0.72 |
| 20. 15S7(90%),IPA(10%) | 2 | 10 | 51.82 | 42.15 | 0.122 | 0.68 | 0.85 | 0.76 |
| 21. " | 4 | 10 | 52.14 | 42.69 | 0.119 | 0.42 | 0.56 | 0.49 |
| L. Wellington Coal, ¼ × 0 | | | | | | | | |
| 1. None | — | 3.2 | 53.20 | 49.97 | 0.041 | — | — | — |
| 2. Fuel Oil | 2 | 3.2 | 53.90 | 50.69 | 0.041 | 0.35 | 0.36 | 0.36 |
| 3. " | 4 | 3.2 | 53.55 | 49.57 | 0.050 | 0.08 | −0.10 | −0.02 |
| 4. 1059(90%), IPA(10%) | 2 | 3.2 | 53.46 | 50.44 | 0.038 | 0.13 | 0.24 | 0.19 |
| 5. " | 4 | 3.2 | 53.47 | 50.47 | 0.038 | 0.07 | 0.13 | 0.10 |
| 6. 15S7(90%), IPA(10%) | 2 | 3.2 | 53.59 | 50.76 | 0.036 | 0.19 | 0.39 | 0.29 |
| 7. 4 | 3.2 | 53.18 | | 49.69 | 0.044 | −0.01 | −0.07 | −0.02 |
| 8. None | — | .50 | 50.20 | 41.03 | 0.116 | — | — | — |
| 9. Fuel Oil | 2 | 5.0 | 51.30 | 43.03 | 0.105 | 0.55 | 1.00 | 0.78 |
| 10. " | 4 | 5.0 | 51.46 | 43.97 | 0.095 | 0.32 | 0.74 | 0.53 |
| 11. 1059(90%), IPA(10%) | 2 | 5.0 | 51.29 | 43.27 | 0.102 | 0.55 | 1.12 | 0.84 |
| 12. " | 4 | 5.0 | 51.32 | 43.49 | 0.099 | 0.28 | 0.62 | 0.45 |
| 13. 15S7(90%), IPA(10%) | 2 | 5.0 | 52.18 | 44.90 | 0.092 | 0.99 | 1.93 | 1.45 |
| 14. " | 4 | 5.0 | 52.35 | 45.51 | 0.087 | 0.54 | 1.12 | 0.83 |
| 15. None | — | 10 | 52.31 | 41.25 | 0.140 | — | — | — |
| 16. Fuel Oil | 2 | 10 | 52.41 | 41.52 | 0.138 | 0.05 | 0.04 | 0.05 |
| 17. Fuel Oil | 4 | 10 | 52.29 | 41.43 | 0.137 | −0.01 | 0.05 | 0.02 |
| 18. P1059(90%), IPA(10%) | 2 | 10 | 52.38 | 42.69 | 0.123 | 0.04 | 0.22 | 0.13 |
| 19. " | 4 | 10 | 52.44 | 43.02 | 0.119 | 0.03 | 0.44 | 0.24 |
| 20. 15S7(90%), IPA(10%) | 4 | 10 | 52.76 | 42.00 | 0.136 | 0.22 | 0.37 | 0.29 |
| 21. " | 4 | 10 | 52.99 | 43.31 | 0.122 | 0.17 | 0.52 | 0.44 |
| M. Maple Creek, As Recieved | | | | | | | | |
| 1. None | — | 10 | 49.33 | 43.90 | 0.069 | — | — | — |
| 2. Fuel Oil | 2 | 10 | 49.44 | 44.48 | 0.063 | 0.06 | 0.29 | 0.17 |
| 3. Octyl Alcohol | 2 | 10 | 49.36 | 44.53 | 0.061 | 0.01 | 0.31 | 0.16 |
| 4. Harchemex | 2 | 10 | 50.16 | 45.27 | 0.062 | 0.41 | 0.68 | 0.54 |
| 5. Octyl Alcohol (50%) Harchemex (50%) | 2 | 10 | 50.15 | 46.10 | 0.051 | 0.41 | 1.10 | 0.76 |
| N. Maple Creek, As Received | | | | | | | | |
| 1. None | — | 10 | 48.95 | 45.27 | 0.047 | — | — | — |
| 2. Fuel Oil | 2 | 10 | 48.00 | 44.73 | 0.041 | −0.47 | −0.27 | −0.37 |
| 3. Harchemex (100%) | 2 | 10 | 49.17 | 46.05 | 0.039 | 0.11 | 0.39 | 0.25 |
| 4. Harchemex (90%) Octyl Alcohol (10%) | 2 | 10 | 49.61 | 46.89 | 0.034 | 0.33 | 0.81 | 0.57 |
| 5. Octyl(80%), Alcohol(20%) | 2 | 10 | 49.49 | 46.68 | 0.036 | 0.27 | 0.70 | 0.46 |
| 6. Octyl(70%), Alcohol(30%) | 2 | 10 | 49.14 | 46.50 | 0.033 | 0.09 | 0.61 | 0.35 |
| 7. Octyl(60%), Alcohol(40%) | 2 | 10 | 49.27 | 46.75 | 0.032 | 0.16 | 0.74 | 0.45 |
| 8. Octyl(50%), Alcohol(50%) | 2 | 10 | 49.02 | 46.30 | 0.034 | 0.04 | 0.51 | 0.28 |
| O. Altheus Coal, ¼ × 0 | | | | | | | | |
| 1. None | — | 8 | 52.45 | 41.36 | 0.137 | — | — | — |
| 2. Fuel Oil | 4 | 8 | 52.97 | 43.40 | 0.121 | 0.13 | 0.51 | 0.32 |
| 3. 15S7(90%), IPA(01%) | 4 | 8 | 53.41 | 43.76 | 0.122 | 0.24 | 0.60 | 0.42 |
| 4. Harchemex (90%) Octyl Alcohol (10%) | 4 | 8 | 53.28 | 43.68 | 0.122 | 0.21 | 0.58 | 0.39 |
| 5. Harchemex (80%) Octyl Alcohol (20%) | 4 | 8 | 53.61 | 43.82 | 0.124 | 0.29 | 0.62 | 0.46 |
| 6. Harchemex (70%) Octyl Alcohol (30%) | 4 | 8 | 53.33 | 43.72 | 0.122 | 0.22 | 0.59 | 0.41 |
| 7. Harchemex (60%) | 4 | 8 | 53.45 | 43.84 | 0.122 | 0.25 | 0.62 | 0.42 |

TABLE I-continued

| Treatment | Treatment Rate (pints/ton) | Surface Moisture (%) | Bulk Density lb/ft³(W.B.) Max. | Min. | B | P Performance Code Max. | Min. | Avg. |
|---|---|---|---|---|---|---|---|---|
| Octyl Alcohol (40%) | | | | | | | | |
| 8. Harchemex (50%) Octyl Alcohol (50%) | 4 | 8 | 53.20 | 43.89 | 0.118 | 0.19 | 0.64 | 0.41 |
| 9. Harchemex (40%) Octyl Alcohol (60%) | 4 | 8 | 53.40 | 43.57 | 0.124 | 0.24 | 0.55 | 0.40 |

In connection with the non-fuel-oil-containing treatment materials, formulations were prepared with Tergitol 15S7 in oil and water containing graphite, a well known solid lubricant, and Aerosil 200, a finely divided fumed silica. As shown in Table II (below) Section A, the addition of graphite powder alone to fuel oil results in a significant decrease in compacted bulk density and an overall loss of performance even though the compressibility dropped by almost 50% of its original value. When graphite powder was added to a 90/10 mixture of Tergitol 15S7 and IPA in fuel oil, essentially the same behavior was observed. It was not possible to obtain an aqueous suspension of graphite for test purposes. The addition of 1% Aerosil 200 to a 90/10 mixture of Tergitol 15S7 and IPA in fuel oil resulted in no significant alteration in performance. On the other hand, the addition of 1% Aerosil 200 to a 20% aqueous solution of Tergitol 15S7 resulted in a dramatic improvement, particularly in compacted bulk density. In comparison to the same solution containing no Aerosil 200, performance was essentially doubled.

Because the effect of fumed silica on aqueous surfactant solutions was so considerable, further investigations were carried out, as reflected in Section B of Table II. The proportions of Tergitol 15S7 and Aerosil 200 were varied over the ranges of 5 to 20% and 1 to 3%, respectively, to determine the effect upon performance. Decreasing the concentration of 15S7 from 20 to 5% caused average performance coefficients to fall from 0.39 to 0.33 in formulations containing 1% Aerosil and from 0.45 to 0.33 in those containing 3% Aerosil. Increasing the amount of Aerosil at a constant concentration of 15S7 results in performance improvements in all cases with the exception of formulations containing 5% Tergitol 15S7.

In general, it may be said that in these processes involving water, the more surfactant and the more lubricating material the better, subject, however, to economic considerations.

TABLE II

| Treatment | Treatment Rate (pints/ton) | Surface Moisture (%) | Bulk Density lb/ft³ (W.B.) Max. | Min. | B | P Performance Code Max. | Min. | Avg. |
|---|---|---|---|---|---|---|---|---|
| A. Corbin Coal, ¼ × 0 | | | | | | | | |
| 1. None | — | 10 | 54.16 | 44.35 | 0.124 | — | — | — |
| 2. Fuel Oil | 8 | 10 | 53.61 | 44.69 | 0.113 | −.07 | .04 | −.02 |
| 3. Tergitol 15S7(9.0%) IPA(1.0%) Fuel Oil (90%) | 8 | 10 | 53.66 | 48.96 | 0.059 | −.06 | .57 | .26 |
| 4. Tergitol 15S7(20%) Water (80%) | 8 | 10 | 54.00 | 48.07 | 0.075 | −.02 | .47 | .23 |
| 5. Graphite (5%) Fuel Oil (95%) | 8 | 10 | 50.98 | 45.53 | 0.068 | −.39 | .15 | −.12 |
| 6. Tergitol 15S7(9%) IPA(1%) Graphite (5%) Fuel Oil(85%) | 8 | 10 | 53.31 | 47.83 | 0.069 | −.10 | 0.44 | 0.17 |
| 7. Tergitol 15S7(20%) Aerosil 200(1%) Water(79%) | 8 | 10 | 56.91 | 50.37 | 0.082 | .34 | 0.75 | 0.53 |
| 8. Tergitol 15S7(9%) IPA(1%) Aerosil(1%) Fuel Oil (89%) | 8 | 10 | 54.40 | 47.57 | 0.086 | 0.03 | 0.40 | 0.22 |
| B. Corbin Coal, ¼ × 0 | | | | | | | | |
| 1. None | — | 3 | 48.80 | 40.82 | 0.101 | — | — | — |
| 2. 15S7(20%), $H_2O$(79%) Aerosil(1%) | 8 | 3 | 51.36 | 44.51 | 0.087 | 0.32 | 0.46 | 0.39 |
| 3. 15S7(20%), $H_2O$(77%) Aerosil(3%) | 8 | 3 | 52.05 | 44.75 | 0.092 | 0.41 | 0.49 | 0.45 |
| 4. 15S7(10%), $H_2O$(89%) Aerosil(1%) | 8 | 3 | 50.79 | 44.15 | 0.084 | 0.25 | 0.42 | 0.33 |
| 5. 15S7(10%), $H_2O$(87%) Aerosil(3%) | 8 | 3 | 51.37 | 44.20 | 0.091 | 0.32 | 0.42 | 0.37 |
| 6. 15S7(5%), $H_2O$(94%) Aerosil(1%) | 8 | 3 | 51.68 | 43.14 | 0.108 | 0.36 | 0.30 | 0.33 |
| 7. 15S7(5%), $H_2O$(92%) Aerosil(3%) | 8 | 3 | 50.88 | 43.99 | 0.087 | 0.26 | 0.40 | 0.33 |

The following materials were tested to determine their effect upon coal throughput:

a. No. 2 Fuel Oil
b. Tergitol 15S7 (90%), Isopropyl Alcohol (10%)
c. Tergitol 15S7 (20%), Water (80%)
d. Harchemex (90%), Octyl Alcohol (10%)

Formulas "b" and "d" were added 10% by weight to fuel oil.

As shown in the data of Table III (below), throughput is generally a decreasing function of surface moisture. In each case studied, fuel oil treatment reduced coal throughput anywhere from 2 to 22%. An aqueous solution of Tergitol 15S7 resulted in improvements at high and low moistures but a large decrease at a mid-range value. At this time we have no explanation for this anomaly. Harchemex/octyl alcohol mixtures resulted in improvements of 6 to 14% at higher moistures while the Tergitol 15S7/isopropyl alcohol gave improvements of 14 to 33% across the board compared to an appropriate control. In spite of the fact that the coal was not a proper coking coal and the data somewhat inconsistent, it is clear that fuel oil treatments actually decrease throughput while the use of materials found to be effective bulk density modifiers can have a profound and beneficial effect upon grinder or pulverizer throughput.

TABLE III

COAL THROUGHPUT TEST RESULTS OBTAINED GRINDING 2 × 0 VEPCO COAL TO ¼ × 0

| Treatment | Treatment Rate (pint/ton) | Surface Moisture (%) | Power (watts) | Rate (gram/sec) | Throughput (lbs/KwHr) | % Improvement |
|---|---|---|---|---|---|---|
| 1. None | — | 2.0 | 1078 | 150 | 18.35 | — |
| 2. Tergitol 15S7 (20%) Water (80%) | 8 | 2.0 | 990 | 270 | 36.04 | 96.4 |
| 3. None | — | 5.0 | 946 | 169 | 23.63 | — |
| 4. Tergitol 15S7 (20%) Water (80%) | 8 | 5.0 | 968 | 120 | 16.37 | −43.4 |
| 5. None | — | 7.0 | 1540 | 180 | 15.44 | — |
| 6. Tergitol 15S7 (20%) Water (80%) | 8 | 7.0 | 1254 | 164 | 17.29 | 11.9 |
| 7. None | — | 3.2 | 946 | 129 | 17.96 | — |
| 8. None | — | 5.0 | 880 | 113 | 16.90 | — |
| 9. None | — | 7.0 | 902 | 82 | 12.01 | — |
| 10. Fuel Oil | 8 | 3.2 | 902 | 113 | 16.50 | −8.1 |
| 11. Fuel Oil | 8 | 5.0 | 880 | 100 | 15.05 | −10.9 |
| 12. Fuel Oil | 8 | 7.0 | 924 | 82 | 11.75 | −2.2 |
| 13. Tergitol 15S7 (9%) IPA (1%) Fuel Oil (90%) | 8 | 3.2 | 968 | 150 | 20.40 | 13.6 |
| 14. Tergitol 15S7 (9%) IPA (1%) Fuel Oil (90%) | 8 | 5.0 | 880 | 150 | 22.40 | 32.5 |
| 15. Tergitol 15S7 (9%) IPA (1%) Fuel Oil (90%) | 8 | 7.0 | 946 | 113 | 15.7 | 30.8 |
| 16. Harchemex (9%) Octyl Alcohol (1%) Fuel Oil (90%) | 8 | 3.2 | 946 | 129 | 17.96 | 0.0 |
| 17. Harchemex (9%) Octyl Alcohol (1%) Fuel Oil (90%) | 8 | 5.0 | 880 | 129 | 19.28 | 14.1 |
| 18. Harchemex (9%) Octyl Alcohol (1%) Fuel Oil (90%) | 8 | 7.0 | 924 | 90 | 12.81 | 6.7 |

The preceding results established a basis for additional work on actual coking coal blends. Individual coking coals are rarely used to produce coke. In order to obtain coke having suitable properties a blend of two or more coals are generally used. In order to establish that the chemical formulations described in this report would show bulk density performance improvements on blends of coal as well as individual coals, blends of coking coal as used at the plant were obtained from a major steel corporation. Three blends were studied: Fairfield, Geneva and Clairton.

Three chemical formulations were used:

1. BDM-10CAX, a concentrated additive to fuel oil composed of 90% Tergitol 15S7 and 10% isopropyl alcohol.

2. BDM-10CBX, a concentrated additive to fuel oil composed of 90% Harchemex and 10% octyl alcohol.

3. BDM-10WX, an aqueous formulation designed to substitute entirely for fuel oil and composed of 89% water, 10% Tergitol 15S7 and 1.0% fumed silica.

The experimental data obtained on bulk density and throughput measurements are listed in Table III and discussed below.

TABLE III

EXPERIMENTAL RESULTS ON AS-RECEIVED BLENDS

| Treatment | Treatment Rate Wt % | Treatment Rate P/T | Power (watts) | Grinding Rate (lb/hr) | Throughput (lb/KwHr) | % Throughput Improvement | Bulk[1] Density (lb/ft³) | Std. Deviation (lb/ft³) | Performance Coefficient Px | % Bulk Density Improvement |
|---|---|---|---|---|---|---|---|---|---|---|
| A. FAIRFIELD (8.5% Moisture) | | | | | | | | | | |
| 1. None | — | — | 798 | 1072 | 1343 | — | 48.90 | 0.18 | — | — |
| 2. Fuel Oil | 0.1 | 2.2 | 783 | 892 | 1139 | −15.6 | 51.43 | 0.10 | 1.15 | — |
| 3. BDM10CAX[3] | " | " | 895 | 1428 | 1595 | 18.8 | 51.42 | 0.22 | 1.15 | 0.0 |

TABLE III-continued

EXPERIMENTAL RESULTS ON AS-RECEIVED BLENDS

| Treatment | Treatment Rate Wt % | Treatment Rate P/T | Power (watts) | Grinding Rate (lb/hr) | Throughput (lb/KwHr) | % Throughput Improvement | Bulk[1] Density (lb/ft³) | Std. Deviation (lb/ft³) | Performance Coefficient Px | % Bulk Density Improvement |
|---|---|---|---|---|---|---|---|---|---|---|
| 4. BDM10CBX[3] | " | " | 847 | 1191 | 1406 | 4.9 | 51.24 | 0.27 | 1.06 | −7.8 |
| 5. BDM10WX | " | 1.9 | 823 | 1785 | 2168 | 61.6 | 50.03 | 0.09 | 0.59 | −48.6 |
| 6. Fuel Oil | 0.3 | 6.7 | 814 | 1072 | 1317 | −1.8 | 51.70 | 0.32 | 0.42 | — |
| 7. BDM10CAX | " | " | 838 | 1492 | 1780 | 27.3 | 51.92 | 0.17 | 0.48 | 14.3 |
| 8. BDM10CBX | " | " | 785 | 1072 | 1365 | 1.8 | 52.14 | 0.25 | 0.48 | 14.3 |
| 9. BDM10WX | " | 5.8 | 950 | 2381 | 2506 | 86.9 | 51.34 | 0.24 | 0.42 | 0.0 |
| B. GENEVA (5.8% Moisture) | | | | | | | | | | |
| 1. None | — | — | 799 | 1224 | 1532 | — | 48.86 | 0.25 | — | — |
| 2. Fuel Oil | 0.1 | 2.2 | 880 | 1784 | 2027 | 32.5 | 50.74 | 0.09 | 0.85 | — |
| 3. BDM10CAX[3] | " | " | 865 | 1784 | 2062 | 34.5 | 51.31 | 0.04 | 1.11 | 30.6 |
| 4. BDM10CBX[3] | " | " | 1014 | 2379 | 2346 | 53.3 | 51.41 | 0.04 | 1.15 | 35.2 |
| 5. BDM10WX | " | 1.9 | 946 | 1947 | 2058 | 34.5 | 49.65 | 0.78 | 0.42 | −50.6 |
| C. CLAIRTON (6.5% Moisture) | | | | | | | | | | |
| 1. None | — | — | 818 | 1021 | 1248 | — | 49.29 | 0.06 | — | — |
| 2. Fuel Oil | 0.3 | 6.7 | 796 | 893 | 1121 | −10.2 | 51.75 | 0.06 | 0.37 | — |
| 3. BDM10CAX[3] | " | " | 876 | 1429 | 1631 | 31.4 | 52.13 | 0.34 | 0.42 | 13.4 |
| 4. BDM10CBX[3] | " | " | 816 | 1191 | 1459 | 16.9 | 52.52 | 0.14 | 0.48 | 29.7 |
| 5. BDM10WX | " | 5.8 | 968 | 1786 | 1845 | 47.8 | 51.98 | 0.16 | 0.46 | 24.3 |

[1]Wet basis, @ 16.5 psi, average of triplicate runs.
[2]Relative to fuel oil control.
[3]Dissolved 10% by weight in fuel oil.

When bulk density measurements were made on the Fairfield blend, fuel oil at 2.2 pints/ton resulted in a performance coefficient of 1.15 by raising the bulk density of an untreated control from 48.90 lb/ft³ to 51.42 lb/ft³ at an as received surface moisture of 8.5%.

Essentially the same response was obtained with 2.2 pints/ton of fuel oil containing 10% BDM10CAX which yielded a performance coefficient of 1.15. Using 2.2 pints/ton of fuel oil containing 10% BDM10CBX, the performance coefficient dropped slightly to 1.06 corresponding to an increase of 2.34 lb/ft³.

Replacing fuel oil with Pentron BDM10WX at 1.9 pints/ton resulted in a sharp decrease in response and a performance coefficient of 0.59 corresponding to an increase from 48.90 lb/ft³ to 50.03 lb/ft³.

When treatment rates were increased to 0.3% by weight this trend in performance was reversed. While 6.7 pints/ton fuel oil increased bulk density to 51.70 lb/ft³ for a performance coefficient of 0.42, both BDM10CAX and 10CBX at 10% by weight of fuel oil resulted in improvements of 14.3% yielding performance coefficients of 0.48 at the same treatment rate.

Likewise, 5.8 pints/ton of BDM-10WX was found to be an equivalent replacement for 6.7 pints/ton of fuel oil, possessing a performance coefficient of 0.42.

Significant increases in coal throughput were obtained when the chemical formulations were added to or substituted for fuel oil. Interestingly, a fuel oil treatment alone resulted in a 15.6% reduction in throughput at a treatment rate of 2.2 pints/ton and a smaller reduction of 1.8% at a treatment rate of 6.7 pints/ton. Incidentally, in separate work on steam coals we have found that increasing moisture decreases coal throughput and that fuel oil generally makes a bad situation worse.

When BDM-10CAX is added to fuel oil at 10% (W/W) and the mixture applied to coal at 2.2 pints/ton, an 18.8% improvement in throughput relative to an untreated control was obtained. At a treatment rate of 6.7 pints/ton, this figure was further increased to 27.3%.

Throughput response was considerably lower, but still better than fuel oil using BDM-10CBX. Improvements of 4.9% and 1.8% relative to an untreated control were obtained at treatment rates of 2.2 and 6.7 pints/ton, respectively.

The largest throughput increases were observed when BDM10WX was substituted for fuel oil. At 1.9 pints/ton, throughput increased to 2168 lbs/Kw-Hr from a control value of 1343 lbs/Kw-Hr—an increase of 61.6%. At 5.8 pints/ton of BDM-10WX, the improvement in throughput was greater still, 86.96%. In this latter case a 19% power increase was coupled with a 122% increase in grinding rate.

On the Geneva blend at an as received surface moisture of 5.8%, a conventional fuel oil treatment applied at 2.2 pints/ton resulted in a performance coefficient of 0.85, increasing bulk density from 48.86 lb/ft³ to 50.74 lb/ft.

Both BDM10CAX and 10CBX resulted in large improvements in bulk density when 10% by weight was added to fuel oil. At a treatment rate of 2.2 pints/ton the BDM10CAX fuel oil mixture possessed a performance coefficient of 1.11 while that for BDM-10CBX was 1.15 representing improvements in bulk density adjustments of 30.6 and 35.3%, respectively.

No advantage in bulk density adjustment was obtained when BDM-10WX was substituted for fuel oil. The performance coefficient obtained was 0.42 at a treatment rate of 1.9 pints/ton. Bulk density was increased from 48.86 lb/ft³ to 49.65 lb/ft³ compared to 50.74 lb/ft³ for the fuel oil control.

In contrast to the Fairfield blend, a 32.5% increase in throughput was obtained using 2.2 pints/ton of fuel oil on the Geneva blend compared to an untreated control.

When BDM-10CAX was blended with fuel oil at 10% by weight, this figure was increased to 34.5% with throughput increasing from 1532 lbs/Kw-Hr for an untreated control to 2062 lbs/Kw-Hr.

BDM-10CBX proved to be superior to BDM-10CAX by increasing throughput, under the same conditions, from 1532 lbs/Kw-Hr to 2346 lbs/Kw-Hr translating into an improvement of 53.3%.

Surprisingly, the substitution of BDM10WX for fuel oil did not result in the large improvements obtained on the Fairfield blend. Compared to an untreated control, throughput was increased by 34.5%, essentially the same value obtained for BDM-10CAX and only marginally better than fuel oil alone.

In order to correspond as closely as possible to plant practice, samples of the Clairton blend were treated prior to grinding at a treatment rate of 0.3% by weight. At an as received surface moisture of 6.5%, fuel oil at 6.7 pints/ton increased the bulk density of an untreated control from 49.29 lb/ft$^3$ to 51.75 lb/ft$^3$ for a performance coefficient of 0.37.

When 10% by weight BDM-10CBX or BDM-10CAX was added to fuel oil and the mixture applied at a rate of 6.7 pints/ton, bulk density was increased to 52.13 and 52.52 lb/ft$^3$ for performance coefficients of 0.42 and 0.48 respectively. These figures correspond to improvements of 13.5% for BDM-10CAX and 29.7% BDM-10CBX.

Substituting BDM-10WX for fuel oil also resulted in significantly better performance. Bulk density was raised to 51.98 lb/ft$^3$ for a performance coefficient of 0.46 or an improvement of 24.3% at a treatment rate of 5.8 pints/ton.

As was the case with the Fairfield blend, the use of fuel oil decreased throughput from 1248 lb/Kw Hr to 1121 lb/Kw-Hr or 10.2% relative to an untreated control.

The poor performance of fuel oil was reversed when 10% by weight BDM-10CAX or 10CBX was added to fuel oil and the mixture applied at a rate of 6.7 pints/ton. Throughput was raised to 1631 and 1459 lb/Kw-Hr for improvements of 31.4% and 16.4%, respectively, compared to an untreated control.

Likewise the use of BDM-10WX at 5.8 pints/ton substituting for fuel oil resulted in a throughput improvement of 47.8% with an 18.3% increase in power consumption leading to a 75.2% increase in grinding rate.

The preceding coking coal blends were subjected to bulk density and throughput measurements in an as-received condition which were assumed to be representative of typical plant operation. Since one of the major problems in adjusting the bulk densities of coking coal is the presence of excessive amounts of surface moisture, the Clairton blend was chosen for further work to determine whether additive improvements were sustained at higher moistures.

Consequently, specimens of −4 mesh Clairton coal were prepared at surface moistures of 0, 6.5, 10.5, and 14.5%. These specimens were treated with fuel oil, containing 10% BDM10CAX and 10CBX, respectively, and BDM10WX at a rate of 0.3% by weight of coal. Both compacted (16.5 psi) and uncompacted bulk densities were measured.

As shown in the date of Table IV, compacted performance coefficients show a steady decrease up to 10.5% moisture. At 14.5% moisture, the fuel oil performance coefficient has undergone a further decline while those for BDM-10CAX, 10CBX and 10WX have all increased. The case of BDM-10WX is particularly intriguing. BDM10WX does not compare very favorably to 10CAX or 10CBX at or below 6.5% moisture. At higher moisture contents, however, it is vastly superior. For example, at 14.5% moisture the compacted bulk density of an untreated control was 54.28 lb/ft$^3$. Fuel oil increased this figure to 54.76 lb/ft$^3$ while BDM10CAX and 10CBX led to increases to 55.72 and 55.77 lb/ft$^3$, respectively. BDM10WX, however, resulted in a bulk density of 56.70 lb/ft$^3$, which translates into a percentage improvement of 500% compared to fuel oil and over 250% in relation to the other additive treatments.

Essentially similar behavior was observed on uncompacted bulk density with two major exceptions. Firstly, BDM-10WX showed an extremely high performance coefficient on dry coal with a performance coefficient of 0.86 compared to 0.54 to 0.57 obtained with other treatments. Secondly, at 6.5% moisture BDM10CBX was the only additive to exhibit an improvement over fuel oil. Again, BDM10WX was greatly superior at higher moisture contents and the rate of performance loss was found to be less for BDM10CAX and 10CBX containing oils than for fuel oil alone.

As previously mentioned, oxidized coal consumes excessive amounts of fuel oil in the adjustment of bulk density. As a result, the degree of oxidation of each coal blend was measured in an attempt to determine whether any correlation with performance coefficients was evident. The method relies upon the fact that oxidized coal is soluble in caustic and the discoloration due to oxidized materials can be detected spectrophotometrically.

The coal blends resulted in solutions having transmittances less than 98% indicating that there were no significant differences in the degree of oxidation from one blend to the other.

TABLE VI

CLAIRTON BLEND BULK DENSITY AS A FUNCTION OF SURFACE MOISTURE

| | Treatment | Rate Pint/Ton | % surface Moisture | Bulk Density (lb/ft$^3$) @ 16.5 psi | Bulk Density (lb/ft$^3$) @ 0 psi | Performance Coefficients $P_{16.5}$ | Performance Coefficients $P_o$ | Percent Improvement @ 16.5 psi | Percent Improvement @ 0 psi |
|---|---|---|---|---|---|---|---|---|---|
| 1. | None | — | 0.0 | 45.58 | 40.35 | — | — | — | — |
| 2. | Fuel Oil | 6.7 | " | 49.92 | 44.00 | 0.65 | 0.54 | — | — |
| 3. | BDM10CAX[1] | " | " | 50.44 | 44.18 | 0.72 | 0.57 | 10.6 | 5.5 |
| 4. | BDM10CBX[2] | " | " | 50.50 | 44.02 | 0.73 | 0.55 | 11.0 | 1.9 |
| 5. | BDM10WX | 5.8 | " | 49.52 | 45.44 | 0.68 | 0.86 | 4.6 | 59.2 |
| 1. | None | — | 6.5 | 49.29 | 38.08 | — | — | — | — |
| 2. | Fuel Oil | 6.7 | " | 51.75 | 42.68 | 0.37 | 0.69 | — | — |
| 3. | BDM10CAX[1] | " | " | 52.13 | 41.43 | 0.42 | 0.50 | 13.5 | −27.5 |
| 4. | BDM10CBX[2] | " | " | 52.52 | 42.82 | 0.48 | 0.71 | 29.7 | 2.9 |
| 5. | BDM10W | 5.8 | " | 51.98 | 40.58 | 0.46 | 0.43 | 24.2 | −37.7 |
| 1. | None | — | 10.5 | 51.46 | 35.15 | — | — | — | — |
| 2. | Fuel Oil | 6.7 | " | 52.12 | 36.86 | 0.10 | 0.26 | — | — |
| 3. | BDM10CAX[1] | " | " | 52.61 | 37.45 | 0.17 | 0.34 | 70 | 30.7 |
| 4. | BDM10CBX[2] | " | " | 52.68 | 37.29 | 0.18 | 0.32 | 80 | 23.1 |
| 5. | BDM10W | 5.8 | " | 53.44 | 38.17 | 0.34 | 0.52 | 340 | 100.0 |
| 1. | None | — | 14.5 | 54.28 | 36.67 | — | — | — | — |
| 2. | Fuel Oil | 6.7 | " | 54.76 | 37.55 | 0.07 | 0.13 | — | — |
| 3. | BDM10CAX[1] | " | " | 55.72 | 38.80 | 0.21 | 0.32 | 200 | 146.2 |

TABLE VI-continued

| Treatment | Rate Pint/Ton | % surface Moisture | Bulk Density (lb/ft³) @ 16.5 psi | Bulk Density (lb/ft³) @ 0 psi | Performance Coefficients $P_{16.5}$ | Performance Coefficients $P_o$ | Percent Improvement @ 16.5 psi | Percent Improvement @ 0 psi |
|---|---|---|---|---|---|---|---|---|
| CLAIRTON BLEND BULK DENSITY AS A FUNCTION OF SURFACE MOISTURE | | | | | | | | |
| 4. BDM10CBX[2] | " | " | 55.77 | 38.58 | 0.22 | 214 | 115.3 | |
| 5. BDM10WX | 5.8 | " | 56.70 | 40.23 | 0.42 | 0.61 | 500 | 369.2 |

[1,2]Dissolved 10% by weight in fuel oil

In connection with the preceding discussion, one might argue that the improvements in coal throughput observed with additive treatments are due to differences in size consist, that is, less power is required to grind to a larger size consist or, alternatively, that mill capacity can be increased by producing less fine coal.

Consequently, treated and ground coal specimens produced in the throughput experiments for the Clairton blend were subjected to sieve analyses. As shown in Table V, no significant differences were observed between fuel oil and additive treatments. In fact, the additive showing the largest improvement in throughput, BDM10WX, produced the finest size consist of all, having the highest percentage of particulate below 200 mesh.

A separate experiment demonstrated that bulk density was generally a decreasing function of particle size. Compacted and uncompacted freshly-ground samples of the Clairton blend were fractionated into −4 to +8, −8 to +16, and −16 mesh sizes. Uncompacted bulk densities decreased from 44.75 to 36.34 while compacted (16.5 psi) bulk densities fell from 49.61 to 47.04 as particle size was decreased over the above range.

Evidently, small differences in size consist can be expected to have a large impact upon bulk density due to the exponential increase in surface area with decreasing particle size. It was felt that this may be extremely significant in terms of the performance of BDM10WX; however, no correlation of bulk density performance coefficients with, for example, percentages of particulate below 200 mesh was obtainable with the available data.

TABLE V

| Treatment | Treatment Rate Wt % | Treatment Rate Pint/ton | Throughput (lb/KwHr) | % of Grind Retained on Mesh 4 | 8 | 16 | 30 | 100 | 200 | 200 |
|---|---|---|---|---|---|---|---|---|---|---|
| CLAIRTON BLEND SIEVE ANALYSES | | | | | | | | | | |
| 1. None | — | — | 1248 | 0 | 5.6 | 19.4 | 26.9 | 30.6 | 8.8 | 6.9 |
| 2. Fuel Oil | 0.3 | 6.7 | 1121 | 0 | 2.0 | 16.1 | 28.1 | 36.2 | 9.0 | 6.0 |
| 3. Fuel Oil (90%) BDM10CAX (10%) | 0.3 | 6.7 | 1631 | 0.6 | 7.4 | 14.2 | 21.0 | 35.8 | 12.5 | 5.6 |
| 4. Fuel Oil (90%) BDM10CBX (10%) | 0.3 | 6.7 | 1459 | 0 | 4.0 | 15.8 | 31.1 | 33.9 | 10.2 | 4.0 |
| 5. BDM10WX | 0.3 | 5.8 | 1845 | 0 | 2.3 | 13.2 | 24.2 | 41.7 | 10.6 | 7.6 |

The ability of oil soluble surfactants to improve the property of fuel oil used to adjust bulk density was found to be correlatable to the increase in spreading coefficient when such surfactants are dissolved in fuel oil.

The method used for determining Spreading Coefficients consists of taking a 6 inch×6 inch square of ⅛ inch thick plexiglass (non-polar surface) and marking cross hairs in the center. Fifteen 1 mm. gradations are made on each arm of the cross hairs. When making the actual measurement 6.25 micro liters of liquid is placed on the opposite side of the plate from where the cross hairs were engraved. This drop is centered on the cross hairs and after one minute the diameter reached on each axis is recorded. From this the final area can be calculated with the formula $A=\pi D^2/4$. Each formula tested was done four times and the final average was used to calculate the spreading coefficient which is simply the final area divided by the drop volume which is constant as mentioned before.

The spreading coefficients of oil containing the surfactants listed in Table 1, section D, were determined and tabulated along with compacted performance coefficients in Table VI. A cursory inspection shows that surfactants which increase the spreading coefficient of oil generally possess high bulk density performance coefficients, while a rigorous mathematical analysis of the data computes to a correlation coefficient of 0.55 valid to an 85% degree of certainty.

TABLE VI

| SURFACTANT | Spreading Coefficients: Spreading Coefficient (mm) | Performance Coefficient |
|---|---|---|
| 1. None, fuel oil | 9.62 | .29 |
| 2. Schercomid ODA | 14.52 | .38 |
| 3. Oleic Acid | 13.85 | .20 |
| 4. Witconate 605A | 13.20 | .38 |
| 5. Emery 531 | 14.30 | .41 |
| 6. Emsorb 2500 | 10.31 | .21 |
| 7. Emsorb 2503 | 12.57 | .26 |
| 8. Emsorb 6903 | 12.41 | .19 |
| 9. Witconate P1059 | 14.86 | .40 |

Based upon the results obtained on actual coking coal blends, it was concluded that:

1. Chemical formulations as additives to, or replacements for, fuel oil result in significantly better response to bulk density adjustment and improve coal throughput in crushing and grinding equipment. Consequently, we anticipate that cost savings will result from reduced purchases of fuel oil and electrical power.

2. Additives to Fuel Oil (a) Pentron BDMlOCAX and lOCBX improve the performance of No. 2 fuel oil for the purpose of bulk density adjustments. Performance improvements as large as 35% were obtained on the as-received coking coal blends.

(b) Both BDMlOCAX and BDMlOCBX were useful for increasing coal throughput in a 1000 lb/hr hammermill grinder. Percentage improvements ranged from 1.8 to 53.3% on the three coking coal blends studied.

(c) The bulk density performance improvements obtained with BDMlOCAX and BDMlOCBX increased with increasing coal surface moisture, ranging from 12.3% on dry coal to 300% at a surface moisture of 14.5%.

3. Aqueous Formulation (a) BDMlOWX was found to be an equivalent substitute for fuel oil on the as-received Clairton blend but less effective upon as-received Geneva and Fairfield coals.

(b) BDMlOWX resulted in large gains in coal throughput with improvements ranging from 35.4% to 86.9% on the as-received blends.

(c) The ability of BDMlOWX to adjust bulk density was found to be a sensitive function of surface moisture. Marginal improvements in bulk density were obtained on dryer coal while performance improvements as high as 500%, exceeding any fuel oil or other additive treatment, were obtained at surface moistures in excess of 10%.

Likewise, it is well known that the addition of surfactants to water increases the wetting and spreading of water on solid surfaces.

This data suggests that the improvements in spreading coefficients of water and oil as a result of surfactant additions are intimately related to the phenomena of bulk density and throughput. The precise relationships of variables influencing the bulk density and throughput characteristic of coal are the objects of continuing research.

The following is a listing of the chemical substances used to prepare the formulations described above.

a. Surfactants (1) Tergitol 15S7—Nonionic $C_{11}$ to $C_{15}$ ethoxylated secondary alcohols
(2) Witcamide 511—Alkoxylated myristyl alcohol
(3) Witconol A—Unknown
(4) Tween 81—Polyoxyethylene (5) sorbitan monooleate
(5) Emsorb 6909—Unknown
(6) Witconol APEM—Unknown
(7) Oleic Acid—Octadecenoic Acid, $CH_3(CH_2)_7CH{:}CH(CH_2)_7COOH$
(8) Shercomid ODA—Oleic acid diethanolamide
(9) Shercomid CDA—Coconut-oil diethanolamide
(10) Witconate 605A—Unknown
(11) Emery 531—Mixture of $C_{14}$ to $C_{18}$ tallow fatty acids
(12) Emsorb 2500—Sorbitan monooleate
(13) Emsorb 2503—Sorbitan trioleate
(14) Emsorb 6903—Polyoxyethylene (20) sorbitan trioleate
(15) Emsorb 6905—Polyoxyethylene (20) sorbitan monostearate
(16) Trylox 6747—Ethoxylated sorbitan hexaoleate
(17) Emid 6545—Oleic acid diethanolamide
(18) Witconate P1059—Alkylarylsulfonate
(19) Shercomid ODA—Oleic acid diethanolamide
(20) Trymeen Tam 8—Polyoxyethylene (20) tallow amine
(21) RW50—Polyethoxyamine, $RNH(OCH_2CH_2)_5OH$
(22) Petromix No. 9—Sodium alkylarylsulfonates
(23) Zonyl FSP—Anionic fluorosurfactant
(24) Zonyl FSN—Amphoteric fluorosurfactant
(25) Zonyl FSA—Anionic fluorosurfactant b. Alcohols (1) Methyl alcohol—$CH_3OH$
(2) Ethyl alcohol—$C_2H_5OH$
(3) Isopropyl alcohol—$C_3H_7OH$
(4) Octyl Alcohol—$C_8H_{17}OH$
(5) Harchemex—Mixture of $C_{14}$ to $C_{18}$ primary alcohols c. Solid Powders (1) Graphite—Powdered −325 mesh graphite
(2) Aerosil 200—Fumed silica, −325 mesh From the above it will be apparent that treating coking coal with the combinative compositions of matter here disclosed permits optimization of bulk density, usually to a degree not attainable by the use of fuel oil alone, while significantly reducing, and even in some cases eliminating, the use of that increasingly rare and expensive natural resource—fuel oil. At the same time the throughput characteristics of the coal, usually decreased by the use of fuel oil, are enhanced by the treatment materials here disclosed.

While but a limited number of embodiments of the present invention are here specifically disclosed, it will be understood that they are merely exemplary, and that the scope of the invention is defined in the following claims.

We claim:

1. A method of improving operative characteristics of coking coal which comprises applying to said coal, in proportions by weight of about 1–10 pints per ton of coal, a treatment material selected from the group consisting of:

(A) The combination of (1) an oil-soluble surfactant having the characteristic, when added to fuel oil, of increasing the spreading coefficient of said fuel oil, (2) an alcohol selected from the group consisting of alcohols having from 1–8 carbon atoms in their chain, and mixtures thereof, and (3) fuel oil, in the substantial absence of water, the components of said treatment material (A) comprising, in approximate proportions by weight, fuel oil 50–99% and the remainder 50–1%, said remainder comprising, in approximate proportions by weight, the surfactant 50–99% and said alcohol 50–1%; and (B) The combination of (1) a water soluble surfactant having the characteristic, when added to water, of increasing the spreading coefficient of water, (2) an inorganic lubricating substance formed of substantially rounded, substantially solid particles, the bulk of which pass a screen of about 375 mesh, and (3) water, in the substantial absence of fuel oil, the components of said treatment material (B) being present in proportions by weight of surfactant 0.1–30%, lubricating substance 1–20%, with the balance substantially all water.

2. The method of claim 1, in which, in the treatment material (A), said oil-soluble surfactant is selected from the group consisting of long chain primary and secondary alcohols, alkylaryl sulfonates and mixtures thereof.

3. The method of claim 1, in which said alcohol is selected from the group consisting of isopropyl and octyl alcohols and mixtures thereof.

4. The method of claim 1, in which the components of said treatment material (A) comprise in approximate proportions by weight of fuel oil 85–95% and the remainder 15–5%, said remainder comprising, in approximate proportions by weight, the surfactant 70–95% and alcohol 30–5%.

5. The method of claim 1, in which the components of said treatment material (A) are present in approximate proportions by weight of fuel oil 90% and the remainder 10%, said remainder comprising in approximate proportions by weight the surfactant 90% and said alcohol 10%.

6. The method of claim 1, in which, in treatment material (B), said water-soluble surfactant is selected from the group consisting of linear alcohols and alkylaryl sulfonates.

7. The method of claim 6, in which said inorganic lubricating substance comprises a fumed silica.

8. The method of claim 6, in which is treatment material (B), the components of said treatment materials are present in proportion by weight of surfactant 1–15%, lubricating substance 1–3%, with the balance substantially all water.

9. The method of claim 6, in which the components of treatment material (B) are present in proportion by weight of about 10% surfactant, 1% lubricating substance, and the balance substantially all water.

10. The method of claim 1, in which said treatment material (A) comprises, in proportions by weight, fuel oil 80–90%, and the remainder comprising 90% of ethoxylated linear secondary alcohol having a chain length of 11–15 carbon atoms and 10% of an alcohol selected from the group consisting of isopropyl and octyl alcohols and mixtures thereof.

11. The method of claim 1, in which said treatment material (A) comprises, in proportions by weight, fuel oil 80–90%, and the remainder comprising 90% of a mixture of primary alcohols having a chain length of 14–18 carbon atoms and 10% of alcohol selected from the group consisting of isopropyl and octyl alcohols and mixtures thereof.

12. The method of claim 1, in which said treatment material (A) comprises, in proportions by weight, fuel oil 80–90%, and the remainder comprising 90% of an alkylaryl sulfonate and 10% of an alcohol selected from the group consisting of isopropyl and octyl alcohols and mixtures thereof.

13. The method of claim 1, in which said treatment material (B) comprises in proportions by weight, an ethoxylated linear secondary alcohol having a chain length of 11–15 carbon atoms, 5–20%; fumed silica 1–3% and the remainder water.

14. The method of claim 1, in which said treatment material (B) comprises in proportions by weight, an ethoxylated linear secondary alcohol having a carbon chain of 11–15 carbon atoms, about 20%; fumed silica, about 1% and the remainder water.

* * * * *

Disclaimer 4,304,636.—*Mark O. Kestner,* Mendham; *Stanley E. Gilewicz,* West Orange; and *Mehmet E. Aktuna,* Morristown, N.J. METHOD FOR IMPROVING THE BULK DENSITY AND THROUGHPUT CHARACTERISTICS OF COKING COAL. Patent dated Dec. 8, 1981. Disclaimer filed Mar. 10, 1983, by the assignee, *Economics Laboratory, Inc.*

Hereby enters this disclaimer to all claims of said patent.

[*Official Gazette May 10, 1983.*]